United States Patent [19]

Motoyoshi et al.

[11] 4,072,515

[45] Feb. 7, 1978

[54] ELECTRICAL CONTACT MATERIAL

[75] Inventors: Kenya Motoyoshi; Masahiro Kume; Yoshinari Amano, all of Itami, Japan

[73] Assignee: Sumitomo Electric Industries, Ltd., Osaka, Japan

[21] Appl. No.: 485,579

[22] Filed: July 3, 1974

[30] Foreign Application Priority Data

July 5, 1973 Japan ..... 47-762654

[51] Int. Cl.[2] ..... C22C 5/06

[52] U.S. Cl. ..... 75/173 A

[58] Field of Search ..... 75/173 A

[56] References Cited

U.S. PATENT DOCUMENTS

| | | | |
|---|---|---|---|
| 2,486,341 | 10/1949 | Stumbock | 75/173 A X |
| 2,572,662 | 10/1951 | Richardson et al. | 75/173 A X |
| 2,669,512 | 2/1954 | Larsen et al. | 75/173 A |
| 2,796,346 | 6/1957 | Stumbock | 75/173 A |
| 3,472,654 | 10/1969 | Comey et al. | 75/173 A |
| 3,607,244 | 9/1971 | Kabayama | 75/173 A |
| 3,874,941 | 4/1975 | Shibata | 75/173 R |

FOREIGN PATENT DOCUMENTS

| | | | |
|---|---|---|---|
| 1,153,178 | 8/1963 | Germany | 75/173 A |
| 2,012,910 | 10/1970 | Germany | 75/173 A |
| 960,592 | 6/1964 | United Kingdom | 75/173 A |

*Primary Examiner*—Arthur J. Steiner

*Attorney, Agent, or Firm*—Wenderoth, Lind & Ponack

[57] ABSTRACT

This invention relates to an electrical contact material of silver-indium oxide type, which is produced by the internal oxidation of an alloy consisting of 6–15% by weight indium, at least one of 0.2–8% by weight tin and 0.01–1% by weight magnesium and the balance silver. This alloy may contain further 0.01–1% by weight of nickel.

3 Claims, No Drawings

ELECTRICAL CONTACT MATERIAL

BRIEF SUMMARY OF THE INVENTION

This invention relates to an electrical contact and, more particularly, it is concerned with an electrical contact of silver-metal oxide type produced by the internal oxidation method and having an improved electrical performance.

Silver-cadmium oxide contacts have widely been used as such silver-metal oxide type contact produced by the internal oxidation method. Since the silver-cadmium oxide contact has evenly a low contact resistance, resistance to welding and resistance to arc erosion, it has widely been used as a relay, contactor or no-fuse breaker for from small to large currents. However, the use of cadmium in the contact material is undesirable for worker's health during the production thereof.

On the other hand, silver-tungsten, silver-tungsten carbide, silver-nickel and silver-graphite are used as a cadmium-free silver type contact material, but the silver-tungsten and silver-tungsten carbide contact materials are inferior to the silver-cadmium oxide contact material in respect of the temperature rising on a contact area mainly due to the increase of the contact resistance when opened and closed many times in the air, while the silver-nickel and silver-graphite contact materials are inferior in respect of the resistance to welding or resistance to arc erosion over a range of medium to large currents. Therefore, the using regions and using conditions, as a contact for a switch in the air, of these contact materials are cosiderably limited. If a contact material having a high resistance to welding or to arc erosion as well as a low contact resistance without using cadmium can be found, this material renders great services to the industry, but there has hitherto been found no alloy equal in quantity to the silver-cadmium oxide contact.

It is an object of the present invention to provide an electrical contact of silver-metal oxide having an improved electrical performance.

It is another object of the invention to provde a cadmium-free silver-metal oxide type contact material which can be favourably compared with the silver-cadmium oxide contact material.

It is a further object of the invention to provide a process for the production of a cadmium-free silver-metal oxide type contact material by the internal oxidation method.

Still more objects will be apparent from the following detailed description.

DETAILED DESCRIPTION OF THE INVENTION

The inventors have found as a result of many studies on various materials that a silver-indium oxide contact material can exhibit an excellent property by adding tin oxide, and/or magnesium oxide and this contact material can preferably be produced by the so-called internal oxidation method. In some case, Ni oxide can further be incorporated therein. As is well known in the art, the advantages of the internal oxidation method consist in dispersing evenly and finely an oxide in a metallic matrix to strengthen the matrix and to raise markedly the heat resistance thereof, which method makes up the main current in the production of the silver-cadmium oxide contact of the prior art.

Therefore, the present invention relates to a silver-indium oxide type electrical contact material which is obtained by the internal oxidation of an alloy consisting of 6–15% by weight indium, at least one of 0.2–8% by weight tin and 0.01–1% by weight magnesium and the balance silver. This alloy may contain further 0.01–1% by weight nickel as occasion demands.

In a preferred embodiment of the present invention, the silver-indium oxide contact material is obtained by the internal oxidation of an alloy consisting of 6–15% by weight indium, 0.2–8% by weight tin and the balance silver.

In another preferred embodiment of the present invention, the silver-indium oxide contact material is obtained by the internal oxidation of an alloy consisting of 6–15% by weight indium, 0.01–1% by weight magnesium, 0.01–1% by weight nickel and the balance silver.

The important feature of the present invention consists in dissolving in silver indium and at least one metal taken from the group consisting of tin, and magnesium, which are less harmful than cadmium, to prepare a corresponding alloy and then subjecting to internal oxidation, thus obtaining a silver-indium oxide contact material having a stable contact characteristic even after opened and closed many times and being substantially equal to the silver-cadmium oxide contact to the prior art in current carrying capacity, which will be apparent from Examples.

The most remarkable effect by the addition of indium and at least one metal taken from the group consisting of tin and magnesium to silver followed by internal oxidation is to strengthen the resistances to welding and to arc erosion of a contact. When using an alloy of silver and indium, silver and tin, silver and magnesium or silver and nickel, subjected to internal oxidation, on the contrary, the welding or arc erosion of a contact is so large that the contact is not suitable for use as a switch for medium and large currents. The effect of the invention can be given by adding indium with at least one of tin and magnesium and optionally with nickel to silver followed by the internal oxidation.

The amount of indium to be dispersed in silver before the internal oxidation is ordinarily 6 to 15% by weight, within which the contact property is effectively shown. The amount of tin to be incorporated in such silver-indium alloy for raising the property as a contact is effectively in the range of 0.2 to 8% by weight. If the amounts of indium and tin are too much, rolling or internal oxidation becomes impossible. The composition range within which the internal oxidation is possible varies with the oxidizing conditions. For example, at an oxidizing temperature of 720° C under an oxygen partial pressure of 0.21 atm, the upper limit of tin is about 8% by weight in the case of 10% by weight of indium. This means that, since the possible concentration of tin is ordinarily about 5% by weight in a binary system of silver-tin, the joint addition of indium and tin serves to increase the possible concentration of tin. Within the above mentioned range, the silver-indium oxide-tin oxide contact is substantially equal to the silver-cadmium oxide contact of the prior art and the current carrying capacity thereof is not lowered.

In another embodiment of the invention, 0.01–1% by weight of magnesium and optionally 0.1–1% by weight of nickel are incorporated in the silver-indium alloy or silver-indium-tin alloy, followed by the internal oxidation, for the purpose of paising largely the electrical performance as a contact. Magnesium can give this effect in a relatively small amount as mentioned above as compared with indium, and preferably in a proportion of 0.05–0.8% by weight. If the amounts of indium and magnesium are too much, rolling or internal oxidation of the alloy becomes unstable. If the amounts of magnesium are too little, on the other hand, the above mentioned effect is hardly given and, therefore, at least 0.1% by weight of magnesium is necessary. Within the above mentioned range the contact is substantially equal to the silver-cadmium oxide contact of the prior art and the current carrying capacity thereof is now lowered.

The marked feature obtained by adding magnesium optionally with nickel to an alloy of silver-indium or silver-indium-tin, followed by the internal oxidiation, is a big increase of the hardness of the alloy. In the case of an alloy of silver-10% indium, for example, the Vickers Hardness (Hv 5 Kg) of 110–120 after the internal oxidation is largely increased by adding 0.1% by weight of magnesium, 0.1% by weight of magnesium and 0.1% by weight of nickel or 0.5% by weight of magnesium and 0.5% by weight of nickel, followed by the internal oxidation, to 170, 175 or 215 respectively. This serves to improve largely the resistances to welding and to arc erosion as is apparent from a contact property test mentioned hereinafter.

The above mentioned silver-indium alloys according to the present invention may further contain small amounts of other elements such as manganese, iron, cobalt, molybdenum, lanthanum, zirconium and aluminum that do not defeat the object of the invention, followed by the internal oxidation.

The following examples are given in order to illustrate the invention without limiting the same.

EXAMPLE 1

89% by weight of silver, 10% by weight of indium and 1% by weight of tin were melted, cast and rolled in a thickness of 1.5 mm. The resulting sheet was subjected to an internal oxidation at 700° C for about 100 hours in an oxygen atmosphere, cut in a specimen of 5 × 6 × 1.5 mm and brazed to a copper base. This specimen was then subjected to an opening and closing test using a contact testing device of ASTM type under conditions of AC 100 V, 30 A and resistance load. After 10,000 times of the switching operation, the voltage drop between contacts was 20–40 mV at a current passage of AC 30 A, which showed that the contact of the invention had substantially the same current carrying capacity as the silver-cadmium oxide contact of the prior art.

EXAMPLE 2

88% by weight of silver, 10% by weight of indium and 2% by weight of tin were melted, cast and rolled in a thickness of 1.5 mm. The resulting sheet was subjected to an internal oxidation at 700° C for about 120 hours in an oxygen atmosphere, cut in a specimen of 5 × 6 × 1.5 mm and brazed to a copper base. Then a current of 2500 A (crest) was passed 1.5 cycles 3 times under conditions of AC 220 V (60 Hz), a contact pressure of 500 g and resistance load and the welding forces were measured during the same time. The contact of the invention had welding forces of 100 g, 250 g and 300 g respectively, being not more than 1 kg, and showed a good appearance, which property was substantially similar to that of the silver-cadmium oxide contact of the prior art.

EXAMPLE 3

84% by weight of silver, 10% by weight of indium and 6% by weight of tin were melted, cast and rolled in a thickness of 1.5 mm. The resulting sheet was subjected to an internal oxidation at 700° C for about 200 hours in an oxygen atmosphere, cut in a specimen of 5 × 6 × 1.5 mm and brazed to a copper base. Then a current of 2500 A (crest) was passed 1.5 cycles 3 times under conditions of AC 220 V (60 Hz), a contact pressure of 500 g and resistance load and the welding forces were measured during the same time. The contact of the invention had welding forces of 200 g, 100 g and 100 g respectively, being not more than 1 kg, and showed a good appearance.

EXAMPLE 4

91% by weight of silver, 8% by weight of indium, 0.5% by weight of magnesium and 0.5% by weight of nickel were melted, cast and rolled in a thickness of 1.5 mm. The resulting sheet was subjected to an internal oxidation at 720° C for about 100 hours in an oxygen atmosphere, cut in a specimen of 5 × 6 × 1.5 mm and brazed to a copper base. This specimen was then subjected to an opening and closing test using a contact testing device of ASTM type under conditions of AC 100 V, 30 A and resistance load. After 10,000 times of the switching operation, the voltage drop between contacts was 20–45 mV at a current passage of AC 30 A, which showed that the contact of the invention had substantially the same current carrying capacity as the silver-cadmium oxide contact of the prior art.

EXAMPLE 5

89.6% by weight of silver, 10% by weight of indium, 0.2% by weight of magnesium and 0.2% by weight of nickel were melted, cast and rolled in a thickness of 2 mm. The resulting sheet was subjected to an internal oxidation at 720° I C for about 150 hours in an oxygen atmosphere, cut in a specimen of 10 × 10 × 2 mm [Specimen e)], fitted to an electromagnetic contactor of 60 ampere frame and then subjected to a contact property test under conditions of a voltage of AC 220 V, current of 370 A, power factor of 0.5 and switching frequency of 180 times per 1 hour.

The similar contact property tests were carried out using contacts of alloys of a) silver-10% indium-0.2% magnesium, b) silver-10% indium-1% tin, c) silver-10% indium-1% tin-0.02% magnesium, d) silver-10% indium-1% tin-0.02% nickel, f) silver-10% indium-1% tin-0.02% magnesium-0.02% nickel, and, for comparison, g) silver-13% cadmium, h) silver-10% indium and i) silver-10% indium-0.2% nickel, which were subjected to internal oxidation. The consumption quantities of these contacts and the voltage drops between contacts after opened and closed 10,000 times are as follows:

| | Specimen | Consumption Quantity | Voltage Drop* |
|---|---|---|---|
| a) | Ag-In oxide-Mg oxide | 355 mg | 115 mV |
| b) | Ag-In oxide-Sn oxide | 350 mg | 110 mV |
| c) | Ag-In oxide-Sn oxide-Mg oxide | 340 mg | 115 mV |
| d) | Ag-In oxide-Sn Oxide-Ni oxide | 345 mg | 110 mV |
| e) | Ag-In oxide-Mg oxide-Ni oxide | 300 mg | 105 mV |
| f) | Ag-In oxide-Sn oxide-Mg oxide Ni oxide | 330 mg | 115 mV |
| g) | Ag-Cd oxide (for comparison) | 500 mg | 105 mV |
| h) | Ag-In oxide (for comparison) | 550 mg | 123 mV |
| i) | Ag-In oxide-Ni oxide | 430 mg | 120 mV |

-continued

| Specimen | Consumption Quantity | Voltage Drop* |
|---|---|---|
| (for comparison) | | |

*Measured at a current passage of AC 150 A, including the contact base.

As evident from these results, the contacts of the invention showed a low consumption.

EXAMPLE 6

88.6% by weight of silver, 11% by weight of indium, 0.2% by weight of magnesium and 0.2% by weight of nickel were melted, cast and rolled in a thickness of 2 mm. The resulting sheet was subjected to an internal oxidation at 720° C for about 150 hours in an oxygen atmosphere, cut in a specimen of 5 × 6 × 2 mm, brazed to a copper base and then subjected to a current breaking test of circuit under conditons of AC 220 A, 3000 A and power factor 0.4.

The similar current breaking tests were carried out using contacts of alloys of silver-11% indium-0.2% magnesium, and, for comparison, of silver-11% indium and silver-13% cadmium, which were subjected to internal oxidation. The current breaking each was carried out two times and the state of arc erosion was observed.

The alloys of silver-indium oxide-magnesium oxide and silver-indium oxide-magnesium oxide-nickel oxide according to the present invention and the alloy of silver-cadmium oxide for comparison showed stable appearances, but the alloy of silver-indium oxide showed a large arc erosion, in particular, a large consumption of end portion.

EXAMPLE 7

87% by weight of silver, 6% by weight of indium and 7% by weight of tin were melted, cast and then rolled in a thickness of 1.5 mm. The resulting sheet was subjected to an internal oxidation at 700° C for about 200 hours in an oxygen atmosphere, cut in a speciment of 5 × 6 × 1.5 mm, brazed to a copper base and subjected to measurement of the welding force under the same conditions as those of Example 2. The welding forces were respectively 280 g, 150 g and 400 g.

EXAMPLE 8

92.6% by weight of silver, 6% by weight of indium, 0.7% by weight of magnesium and 0.7% by weight of nickel were melted, cast and then rolled in a thickness of 1.5 mm. The resulting sheet was subjected to an internal oxidation at 700° C for about 200 hours in an oxygen atmosphere, cut in a specimen of 5 × 6 × 1.5 mm, brazed to a copper base and subjected to measurement of the welding force under the same conditions as those of Example 2. The welding forces thus measured were respectively 400 g, 300 g and 550 g.

EXAMPLE 9

84.9% by weight of silver, 15% by weight of indium, 0.05% by weight of magnesium and 0.05% by weight of nickel were melted, cast and then rolled in a thickness of 1.5 mm. The resulting sheet was subjected to an internal oxidation at 700° C for about 400 hours in an oxygen atmosphere, cut in a specimen of 5 × 6 × 1.5 mm, brazed to a copper base and subjected to measurement of the welding force under the same conditions as those of Example 2. The welding forces measured were 400 g, 260 g and 550 g respectively.

EXAMPLE 10

84.8% by weight of silver, 15% by weight of indium and 0.2% by weight of tin were melted, cast and then subjected repeatedly to rolling and annealing to give a thickness of 1.5 mm. The resulting sheet was annealed at 700° C for 1 hour in a nitrogen atmosphere, washed with a 50% aqueous solution of nitric acid, subjected to an internal oxidation at 700° C for about 300 hours in an oxygen atmosphere, cut in a specimen of 5 × 6 × 1.5 mm, brazed to a copper base and then subjected to measurement of the voltage drop between contacts under the same conditions as those of Example 1. After 10,000 times of the switching operation, the voltage drop between contacts was 30–80 mV at a current passage of AC 30 A.

EXAMPLE 11

(a) 91% by weight of silver, 7% by weight of indium and 2% by weight of tin, (b) 90.98% by weight of silver, 7% by weight of indium, 2% by weight of tin and 0.02% by weight of magnesium, (c) 90.98% by weight of silver, 7% by weight of indium, 2% by weight of tin and 0.02% by weight of nickel and (d) 90.96% by weight of silver, 7% by weight of indium, 2% by weight of tin, 0.02% by weight of magnesium and 0.02% by weight of nickel were respectively melted, cast and then rolled in a thickness of 2 mm. The resulting sheets were subjected to an internal oxidation at 700° C for about 200 hours in an oxygen atmosphere, cut in a specimen of 10 × 10 × 2 mm and then subjected to the similar test to that of Example 5. The consumption quantities of these contacts and the voltage drops between contacts after 10,000 times of the switching operation are as follows:

| | Specimen | Consumption Quantity | Voltage Drop* |
|---|---|---|---|
| a) | Ag-In oxide-Sn oxide | 450 mg | 100 mV |
| b) | Ag-In oxide-Sn oxide-Mg oxide | 430 mg | 105 mV |
| c) | Ag-In oxide-Sn oxide-Ni oxide | 420 mg | 110 mV |
| d) | Ag-In oxide-Sn oxide-Mg oxide-Ni oxide | 400 mg | 115 mV |

*Measured at a current passage of AC 150 A, including the contact base.

As apparent from Examples, the contacts of silver-indium oxide-tin oxide type and silver-indium oxide-magnesium oxide type according to the present invention have excellent resistances to contact consumption, to welding and to arc erosion as well as excellent current carrying capacity, which are useful industrially, and thus are similar to or superior to the silver-cadmium oxide contacts of the prior art as a contactor, no-fuse breaker and breaker in the air.

What is claimed is:

1. An electrical contact material of silver-indium oxide type, which is produced by the internal oxidation of an alloy consisting of 6–15% by weight indium, 0.2–8% by weight tin, 0.01–1% by weight magnesium and the balance silver.

2. An electrical contact material of silver-indium oxide type, which is produced by the internal oxidation of an alloy consisting of 6–15% by weight indium, 0.01–1% by weight magnesium and the balance silver.

3. An electrical contact material of silver-indium oxide type, which is produced by the internal oxidation of an alloy consisting of 6–15% by weight indium, 0.01–1% by weight magnesium, 0.01–1% by weight nickel and the balance silver.

* * * * *